US012698700B2

(12) United States Patent
Combs et al.

(10) Patent No.: US 12,698,700 B2
(45) Date of Patent: Aug. 4, 2026

(54) DISPLAYING CONFIDENCE VALUES IN WELLBORE INVERSION MODELING USING A VISUAL INDICATOR

(71) Applicant: Halliburton Energy Services, Inc., Houston, TX (US)

(72) Inventors: Jeremy James Combs, The Woodlands, TX (US); Nigel Clegg, Norwich (GB); Paul Blair Johnson, Houston, TX (US); Vytautas Usaitis, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1017 days.

(21) Appl. No.: 17/821,720

(22) Filed: Aug. 23, 2022

(65) Prior Publication Data

US 2024/0068348 A1 Feb. 29, 2024

(51) Int. Cl.
*E21B 44/00* (2006.01)
*E21B 7/06* (2006.01)

(52) U.S. Cl.
CPC ..... *E21B 44/00* (2013.01); *E21B 7/06* (2013.01); *E21B 2200/20* (2020.05); *E21B 2200/22* (2020.05)

(58) Field of Classification Search
CPC ..... E21B 44/00; E21B 7/06; E21B 2200/20; E21B 2200/22

(Continued)

(56) References Cited

U.S. PATENT DOCUMENTS 7,636,275 B2 * 12/2009 Anno ..... G01V 1/308 367/21
8,364,404 B2 * 1/2013 Legendre ..... G01V 1/50 702/10

(Continued)

FOREIGN PATENT DOCUMENTS

WO WO-20170058692 A1 * 4/2017 ..... E21B 47/00

OTHER PUBLICATIONS

Wu et al. (A New Generation of Lwd Geosteering Electromagnetic Resistivity Tool Providing Multi-Layered Bed Boundary Detection, Anisotropy Determination, and Azimuthal Resistivity Measurements for Accurate Well Placement and Formation Evaluation, SPWLA , Jun. 10-15, 2022, pp. 1-10) (Year: 2022).*

(Continued)

*Primary Examiner* — Iftekhar A Khan
(74) *Attorney, Agent, or Firm* — Kilpatrick Townsend & Stockton LLP

(57) ABSTRACT

A system can display confidence values in a wellbore inversion model using a visual indicator. The system can receive downhole data relating to the wellbore from a downhole tool deployed in a wellbore of a geological formation during a wellbore operation. The system can additionally generate an inversion model of the geological formation by performing inversion processing on the downhole data. Furthermore, the system can determine confidence values for the downhole data in the inversion model. Additionally, the system can determine a depth of detection limit for the downhole data based on the confidence values. The system can output the inversion model, the depth of detection limit, and a visual indicator based on the confidence values for display at a display device for use in adjusting the wellbore operation.

20 Claims, 5 Drawing Sheets

(58) Field of Classification Search
USPC ..... 703/10
See application file for complete search history.

(56) References Cited

U.S. PATENT DOCUMENTS 8,743,115 B1 * 6/2014 Mallet ..... G01V 20/00 345/419
8,908,474 B2 * 12/2014 Chu ..... G01V 11/00 367/73
10,400,590 B1 * 9/2019 Aldred ..... E21B 49/00
11,162,349 B2 * 11/2021 Flanagan ..... E21B 7/04
11,473,407 B2 * 10/2022 Tang ..... E21B 43/00
11,693,140 B2 * 7/2023 Tawil ..... G06N 3/09 706/12
12,092,780 B2 * 9/2024 Iqbal ..... G01V 1/288
2014/0368201 A1 * 12/2014 Leblanc ..... G01V 3/26 324/339
2015/0035536 A1 * 2/2015 Tang ..... G01V 3/20 324/339
2017/0205531 A1 * 7/2017 Berard ..... E21B 49/00
2017/0269255 A1 * 9/2017 Wilson ..... G01V 3/38
2017/0306741 A1 * 10/2017 Martakov ..... G01V 3/30
2018/0203151 A1 * 7/2018 Kouchmeshky ..... G01V 3/38
2018/0292563 A1 * 10/2018 Zhong ..... G01V 3/38
2019/0064383 A1 * 2/2019 Song ..... G01V 3/26
2020/0248547 A1 * 8/2020 Fitzgerald ..... E21B 47/002
2021/0231829 A1 * 7/2021 Crawford ..... G01V 5/12
2021/0239873 A1 * 8/2021 Djefel ..... G01V 3/38
2021/0247534 A1 * 8/2021 Bø ..... G01V 1/302
2021/0326721 A1 * 10/2021 Zhang ..... G06N 3/082
2022/0091291 A1 * 3/2022 Zhang ..... G01V 1/282
2022/0129788 A1 * 4/2022 Zhang ..... G06N 3/084
2023/0349286 A1 * 11/2023 Jiang ..... E21B 47/06
2023/0351559 A1 * 11/2023 Spielman ..... G06T 5/50
2023/0384473 A1 * 11/2023 Nie ..... G01V 3/02
2024/0061135 A1 * 2/2024 El Ouair ..... G01V 1/345
2024/0068348 A1 * 2/2024 Combs ..... E21B 7/06

OTHER PUBLICATIONS

International Search Report and Written Opinion, PCT/US2022/075361, May 22, 2023, 12 pages.

* cited by examiner

DISPLAYING CONFIDENCE VALUES IN WELLBORE INVERSION MODELING USING A VISUAL INDICATOR

TECHNICAL FIELD

The present disclosure relates generally to wellbore operations and, more particularly (although not necessarily exclusively), to displaying confidence values in wellbore inversion modeling using a visual indicator.

BACKGROUND

A wellbore can be formed in a subterranean formation for extracting produced hydrocarbon or other suitable material. A wellbore operation can be performed to extract the produced hydrocarbon. The wellbore operation can include or otherwise involve generating inversion models to display wellbore characteristics, such as structural features or fluid boundaries, downhole in the wellbore or borehole.

Inversion is a mathematical process by which data are used to generate a model that is consistent with the data. Inversion models of the wellbore may be misinterpreted due to uncertainty past a limit for depth of detection. Uncertainty in the data can arise from distance from the well trajectory, geology of the wellbore, frequency used by the tools, and other factors related to the data collection of wellbore characteristics. The misinterpreted data may cause mistakes in the wellbore operation, such as steering to a poorly chosen location, and may lead to inefficient or otherwise unsuccessful wellbore operations.

DETAILED DESCRIPTION

Figure 1:
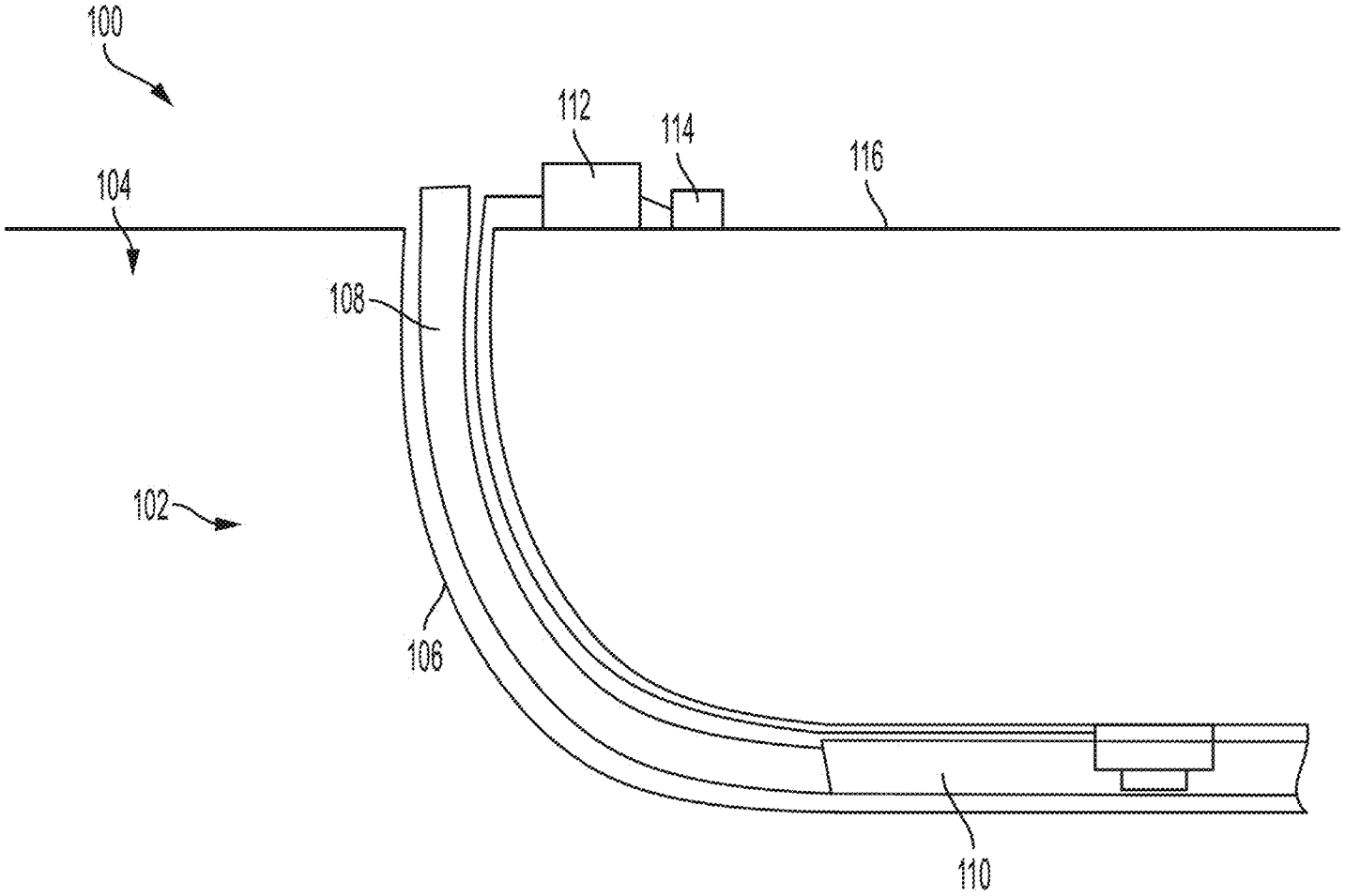
FIG. 1 is a perspective view of a well system with a downhole tool that can be used to collect data according to one example of the present disclosure.

Certain aspects and examples of the present disclosure relate to displaying an inversion model generated using downhole data from a wellbore with a visual indicator that is based on confidence values of inverted downhole data. The downhole data can be resistivity data that is collected by a downhole tool deployed in the wellbore. Resistivity data can be a measurement of electrical resistivity of a geological formation. The inversion model can be a model of the geological formation based on the resistivity data. The accuracy of the resistivity data and the inversion model may decrease at greater distances from the downhole tool. For example, the inversion model may have a depth of detection limit that can represent a distance from the downhole tool at which confidence values for the downhole data remain above a certain threshold. The visual indicator can be overlaid onto the display of the inversion model to represent the confidence values for the downhole data depicted in the inversion model. For example, the visual indicator can adjust a color property, such as an opacity, a hue, a brightness, or a saturation, of a portion of the inversion model based on the confidence values for the portion of the inversion model. The output of the inversion model with the depth of detection limit and the visual indicator can be used to adjust a wellbore operation.

A computing device can display the inversion model of the downhole data, the visual indicator, and the depth of detection limit based on a true vertical depth from a well trajectory. For horizontal well trajectories, the true vertical depth can be a measurement of a line perpendicularly downwards from a horizontal plane. The horizontal plane can be a well surface. The visual indicator may be used to change an opacity value of one or more displayed inversion slices that are outside of the depth of detection limit. The visual indicator can create a convenient way to visually determine if the data represents an actual reservoir characteristic or if a change in the downhole data is misrepresented by the inversion model. The visual indicator displayed on the inversion model can limit mistakes made due to misinterpretations and can add the confidence values to the inversion model. After crossing the depth of detection limit, the visual indicator displayed on the inversion model can decrease in opacity for greater distances from the well trajectory. In some examples, the depth of detection limit may also be displayed with the inversion model. Additionally, the computing device may detect a geological feature, such as a rock formation or a hydrocarbon-bearing formation, within or adjacent to the well trajectory after generating the inversion model, the visual indicator, or a combination thereof. The computing device can then determine an adjustment to the wellbore operation based on the geological feature and automatically control the wellbore operation to perform the adjustment.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a perspective view of a well system 100 with a downhole tool 110 that can be used to collect data according to one example of the present disclosure. The well system 100 can include a wellbore 102 extending through various earth strata. The wellbore 102 can be formed below a well surface 116 within a geological formation 104 that can include hydrocarbon material such as oil, gas, coal, or other suitable material. The geological formation 104 may be formed from geological material such as sand or shale. The geological formation 104 can also include layers of different geological material or pockets of different geological material. Additionally, the wellbore 102 or a well trajectory of the wellbore 102 may be vertical or horizontal with respect to the well surface 116.

The wellbore 102 can include a casing string 108 or other suitable components, such as tubing string, a workstring, etc., for accessing the wellbore 102. The casing string 108 can be constructed from steel or other suitable material. The casing string 108 can be coupled to walls of the wellbore 102 via a sheath made of material such as cement or other suitable coupling material. A sheath 106 can seal off disadvantageous formations, such as flowing salt or fractured formations, in the geological formation 104. The downhole tool 110 can be positioned in the wellbore 102 via the casing string 108 or another suitable component that can deploy the downhole tool 110 in the wellbore 102. In some examples, the casing string 108 can deploy the downhole tool 110 via a surface component 112, such as a winch or other suitable component that can lower or otherwise deploy the downhole tool 110 into the wellbore 102.

A computing device 114 can be used to receive downhole data from the downhole tool 110. In some examples, the computing device 114 can be positioned downhole in the wellbore 102, remote from the well system 100, or in other suitable locations with respect to the well system 100. The computing device 114 can be communicatively coupled to the downhole tool 110, a wireline, other suitable components of the well system 100, or a combination thereof, via a wired or wireless connection. The computing device 114 can be on or above a well surface 116 where the wellbore 102 begins. The downhole tool 110 can be used to collect downhole data. The downhole data 220 can provide information regarding the wellbore 102 and the geological formation 104. In some examples, the downhole tool 110 may be a measurement-while-drilling (MWD) tool. A MWD tool can be a device for incorporating measurement tools into the casing string 108 and can provide substantially contemporaneous ("real-time") downhole data 220. In some examples, the real-time downhole data can be used to adjust steering of a wellbore operation or subsequent wellbore operations. Additionally, the computing device 114 can detect a geological feature in the geological formation 104 adjacent to the well trajectory for a wellbore operation and can determine an adjustment to the wellbore operation based on the confidence values 222 for the geological formation 104. The computing device 114 can automatically control the wellbore operation to perform the adjustment to alter the well trajectory.

Figure 2:
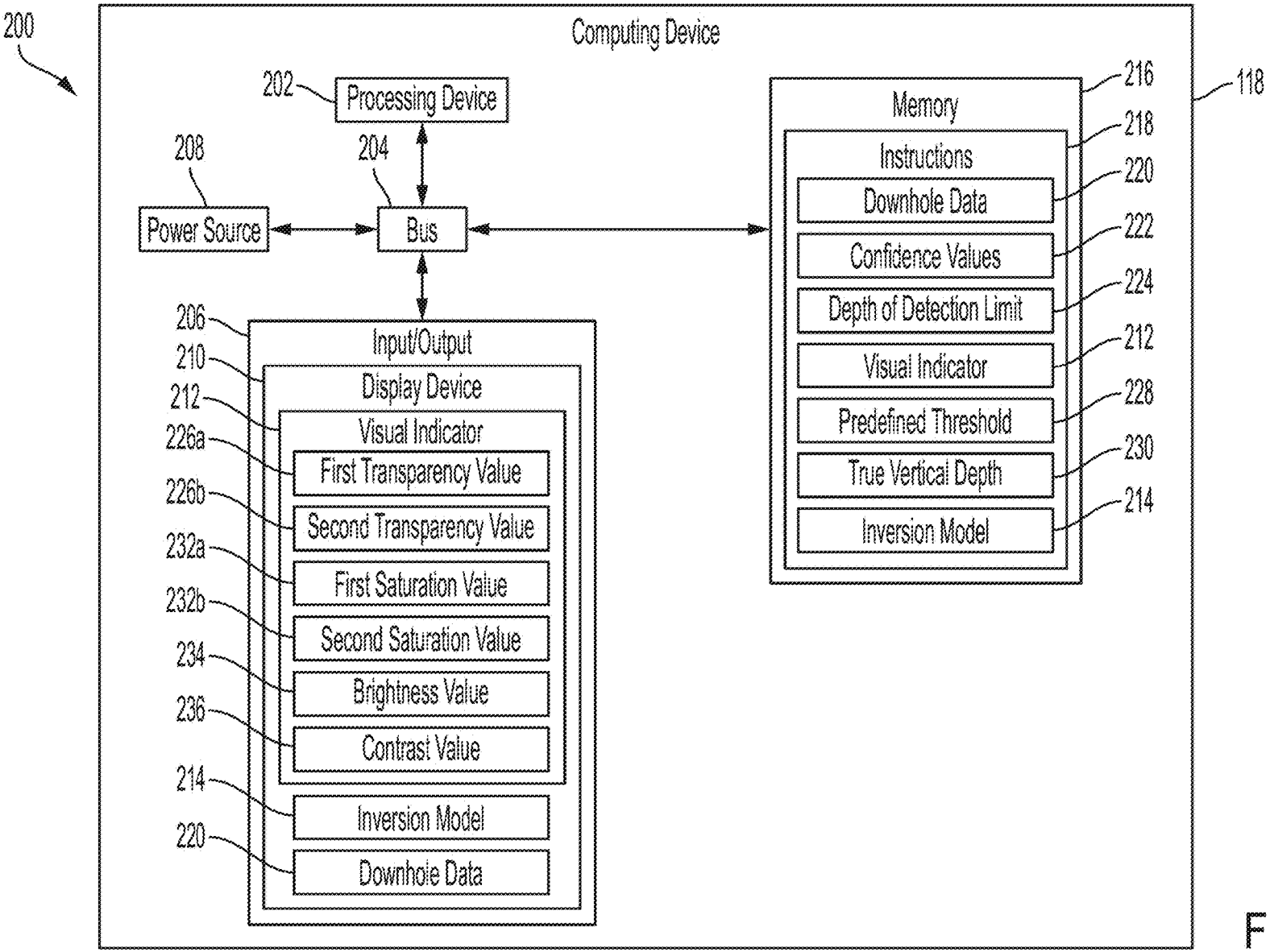
FIG. 2 is a block diagram of a computing system for displaying confidence values in wellbore inversion modeling using a visual indicator according to one example of the present disclosure.

FIG. 2 is a block diagram of a computing system 200 for displaying confidence values 222 in wellbore inversion modeling using a visual indicator 212 according to one example of the present disclosure. FIG. 2 is described with references to components shown in FIG. 1. The components shown in FIG. 2 may be integrated into a single structure, such as within a single housing of the computing device 114. Alternatively, the components shown in FIG. 2 may be distributed from the other components and in electrical communication with the other components.

The computing system 200 may include the computing device 114 that can use downhole data 220 to generate an inversion model 214 of a wellbore 102. The computing device 114 can include a processing device 202, a power source 208, an input/output device 206, and a memory 216 communicatively coupled via a bus 204. The components of the computing device 118 can be parts of a same computing device, or they can be distributed from one another. The input/output device 206 can include a display device 210. Examples of the display device 210 can include a touch-screen display or a computer monitor. The display device 210 can be portable or fixed to a stationary object, such as a monitor arm. In some examples, the power source 208 may include a battery or an electrical cable.

The processing device 202 can include one processing device or multiple processing devices. Non-limiting examples of the processing device 202 include a Field-Programmable Gate Array (FPGA), an application-specific integrated circuit (ASIC), a microprocessing device, etc. The processing device 202 can execute instructions 218 stored in the memory 216 to perform operations. In some examples, the instructions 218 can include processing device-specific instructions generated by a compiler or an interpreter from code written in any suitable computer-programming language, such as C, C++, C #, etc.

The processing device 202 can be communicatively coupled to the memory 216 via the bus 204. The memory 216 can include one memory or multiple memories and can include a memory device. The memory 216 can be non-volatile and may include any type of memory that retains stored information when powered off. Non-limiting examples of the memory 216 include electrically erasable and programmable read-only memory (EEPROM), flash memory, or any other type of non-volatile memory. At least some of the memory can include a non-transitory computer-readable medium from which the processing device 202 can read instructions 218. The non-transitory computer-readable medium can include electronic, optical, magnetic, or other storage devices capable of providing the processing device 202 with computer-readable instructions or other program code. Examples of the non-transitory computer-readable medium include magnetic disk(s), memory chip(s), ROM, random-access memory (RAM), an ASIC, a configured processing device, optical storage, or any other medium from which a computer processing device can read the instructions 218.

In some examples, the memory 216 can include instructions 218 for causing the processing device 202 to receive downhole data 220, such as data transmitted by a downhole tool 110. In some examples, the processing device 202 generates an inversion model 214 based on inverting the downhole data 202. The processing device 202 can additionally determine confidence values 222 for the downhole data 220 represented in the inversion model 214. The confidence values 222 can represent a statistical significance regarding accuracy of the downhole data 220 in the inversion model 214. In some examples, the confidence values 222 can be determined by the processing device 202 using operation characteristics, the downhole data 220, or a combination thereof. Examples of operation characteristics can include distance from a well trajectory of the wellbore 102, spacing used for the downhole tool 110, and material of a geological formation 104. The spacing used for the downhole tool 110 can include a distance between a first portion of the downhole tool 110 and a second portion of the downhole tool 110, such as the distance between a sensor and a receiver.

In one example, the confidence values 222 for a subset of the inversion model 214 at a greater distance from the well trajectory can be lower than the confidence values 222 for another subset of the inversion model at a shorter distance from the well trajectory. Similarly, a greater spacing used for the downhole tool 110 can result in lower confidence values 222 compared to a shorter spacing. The confidence values 222 can be higher for downhole data from a sand-based wellbore compared to the confidence values 222 for downhole data from a shale-based wellbore. Additionally, a type of transmitter used can also affect the determination of the confidence values 222. For example, a type of transmitter with a lower frequency can result in a deeper depth of detection in the geological formation 104.

In some examples, the processing device 202 determine a depth of detection limit 224 based on the confidence values 222. Determining the depth of detection limit 224 can include dividing the inversion model 214 into segments along the wellbore 102. In some examples, the segments may be vertical or horizontal with respect to the well surface 116 or with respect to the wellbore 102. For each segment, a confidence value 222 that exceeds a predefined threshold 228 associated with the depth of detection limit 224 can be determined. The depth of detection limit 224 can be a boundary where the confidence value 222 exceeds the predefined threshold 228 for the segments.

The processing device 202 can output the inversion model 214, the depth of detection limit 224, and a visual indicator 212 for display via the display device 210. The depth of detection limit 224 can be displayed as a solid line, a dotted line, a segmented line, or any other suitable visual representation. The visual indicator 212 may be overlaid on one or more subsets of the inversion model 214. The one or more subsets of the inversion model 214 can be on one side or both sides of the depth of detection limit 224. The visual indicator 212 can be toggled off to view the underlying inversion model 214 more clearly than with the visual indicator 212 toggled on.

The visual indicator 212 can involve adjustments to transparency, hue, saturation, brightness, contrast, pattern, sharpness, or other suitable visual adjustments to the underlying inversion model 214. In some examples, a visual indicator 212 overlaid over a portion of the inversion model 214 may have a saturation value 232 associated with a confidence value 222 for that portion of the inversion model 214. In some examples, the saturation value 232 can range from zero percent saturation to four hundred percent saturation. An adjustment of the saturation value 232 to zero percent saturation for the portion of the inversion model 214 can result in the portion of the inversion model 214 being displayed entirely in grayscale. An adjustment of the saturation value 232 to four hundred percent for the portion of the inversion model 214 can result in the portion being displayed with more vibrant colors than a portion of the inversion model 214 without the visual indicator 212.

In some examples, a first saturation value 232*a* can be lower than a second saturation value 232*b*. The first saturation value can be applied to a first portion of the inversion model 214 with a low confidence value, while the second saturation value can be applied to a second portion of the inversion model 214 with a high confidence value. The first portion of the inversion model 214 can have a color on the grayscale, while the second portion of the inversion model 214 can have a more vibrant color, thereby providing a visual distinction between the first portion and the second portion. In one example, the low confidence value may be a confidence value at fifty percent or lower, while the high confidence value may be a confidence value greater than fifty percent.

Additionally or alternatively, the visual indicator 212 overlaid over a portion of the inversion model 214 can have a transparency value 226 associated with a confidence value 222 for that portion of the inversion model 214. In some examples, the transparency value 226 can range from zero percent transparency to one hundred percent transparency. One hundred percent transparency can result in a removal of a pixel, an image, or other suitable visual representation that can be adjusted for the inversion model 214. Additionally, the visual indicator 212 can reduce an opacity of the subset of the inversion model 214. For example, as depicted in FIG. 2, the processing device can adjust the visual indicator 212 to cause a first portion of the inversion model 214 to have a first transparency value 226*a* and a second portion of the inversion model 214 to have a second transparency value 226*b*. The second transparency value 226*b* may have a lower opacity than the first transparency value 226*a* to indicate that the first portion of the inversion model 214 is associated with a higher confidence value 222 than the second portion of the inversion model 214.

Similarly, the visual indicator 212 can involve adjustments to brightness 234 or contrast 236. Adjustments to brightness or contrast can involve the visual indicator 212 having at least one brightness value 234 or at least one contrast value 236 associated with a confidence value of the confidence values 222. Brightness 234 may be a luminance of pixels, images, or other visual representation that an observer can use to determine a comparative luminance of a different visual representation. The at least one brightness value 234 may range from zero percent to one hundred percent. One hundred percent brightness can be associated with a pure white color, while zero percent brightness can be associated with a pure black color.

Contrast 236 can be a difference in brightness between pixels, objects, or other subsections within a same visual depiction, such as an image. Additionally, contrast 236 can determine the number of shades in the pixels, objects, or other areas in the same visual representation. The at least one contrast value 236 may fall within a range of zero percent to one hundred percent. A visual indicator 212 with zero percent contrast may change the visual representation of the inversion model 214 to display entirely in a same shade of color, such as gray. A visual indicator 212 with one hundred percent contrast may change the visual representation of the inversion model 214 to display with greater vividness of color and less gradation of color than an original version of the inversion model 214.

In some examples, the visual indicator 212 can be displayed with a static visual adjustment that can include a step change in the visual indicator 212 or with a weighted visual adjustment that can include a gradient change in the visual indicator 212. The step change in the visual indicator 212 can include a distinct change or an immediate change in the visual adjustment of the visual indicator 212. For example, crossing the depth of detection limit 224 can result in a change in color for the visual indicator 212 immediately from red to blue. In some examples, the step change in the visual indicator 212 can involve a first pattern for a first region of the inversion model 214 immediately changing to a second pattern for a second region of the inversion model 214 after crossing the depth of detection limit 224. The step change can define a distinct boundary between a first subset of the inversion model 214 and a second subset of the inversion model 214. The inversion model 214 can be interpreted more quickly and more accurately with the step change in the visual indicator 212 compared to an inversion model 214 without the step change in the visual indicator 212.

Additionally or alternatively, the gradient change in the visual indicator 212 can include a gradual change in the visual adjustment of the visual indicator 212. For example, crossing the depth of detection limit 224 can result in a decrease in saturation value by five percent based on a set change in a true vertical depth 230. The difference in the confidence values 222 for one or more regions of the inversion model 214 can more quickly and more accurately interpreted compared to an inversion model 214 without the gradient change. Additionally, the wellbore operation or subsequent wellbore operations can be adjusted using the gradient change in the visual indicator 212.

In some examples, one or more wellbore operations can be adjusted based on the inversion model 214 and the visual indicator 212. Additionally or alternatively, subsequent wellbore operations can be adjusted based on the displayed data for a current wellbore operation. For example, a location for a subsequent wellbore can be decided using the inversion model 214 and visual indicator 212. In some examples, the processing device 202 may use the visual indicator 212 and the inversion model 214 to detect a geological feature in the geological formation 104 that is adjacent to the well trajectory for the one or more wellbore operations. The visual indicator 212 can demarcate one or more regions of the inversion model 214 with different confidence values 222 to enable a relatively quick comparison of confidence values 222 in a first region to a second region. An adjustment to the one or more wellbore operations can be determined based on the confidence values 222 for the geological formation 104. The processing device 202 can then automatically control the one or more wellbore operations or the subsequent wellbore operations to perform the adjustment to alter the well trajectory.

Figure 3:
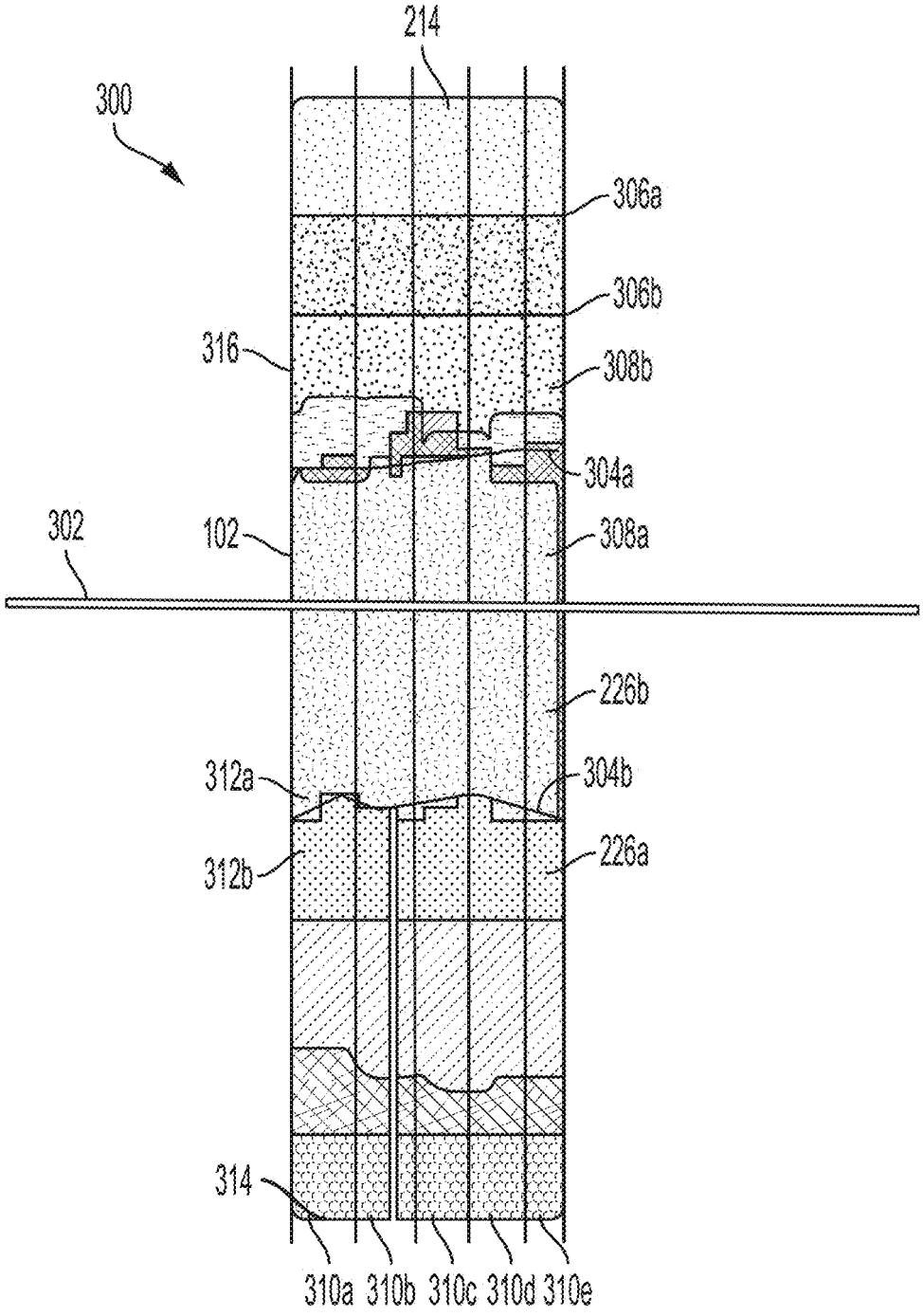
FIG. 3 is an example of a graphical user interface of an inversion model of a wellbore with a visual overlay based on transparency values according to one example of the present disclosure.

FIG. 3 is an example of a graphical user interface 300 of an inversion model 214 of a wellbore 102 with a visual overlay 316 based on transparency values 226*a-b* according to one example of the present disclosure. FIG. 3. is described with references to components shown in FIGS. 1-2.

The inversion model 214 can be outputted for display by a computing device 118 as a graphical user interface 300 after the inversion model 214 is generated. The inversion model 214 shown in FIG. 3 depicts a well trajectory 302 that is horizontal with respect to a well surface, such as the well surface 116 depicted in FIG. 1. The inversion model 214 can be sectioned into vertical segments 310*a-e*. In alternative embodiments depicting a well trajectory 302 that is vertical with respect to the well surface 116, the inversion model 214 can be sectioned into horizontal segments (not shown).

Additionally, the inversion model 214 can include one or more regions 308*a-b* delineated by different colors, patterns, other suitable color properties such as saturation, opacity, hue, brightness, or other suitable visual differences that represent a difference in the downhole data 220 for each region of the inversion model 214. As an example, and as depicted in FIG. 3, relatively high resistivity data of the geological formation 104 in the inversion model 214 can be represented by a first region 308*a*. Additionally, as depicted in FIG. 3, relatively low resistivity data of the geological formation 104 in the inversion model 214 can be represented by a second region 308*b*. Based on the visual difference between the first region 308*a* and the second region 308*b*, the first region 308*a* may be determined to have a higher resistivity than the second region 308*b*. A wellbore operation or subsequent wellbore operations can be directed accordingly.

Confidence values 222 can be a statistical representation of confidence in the downhole data 220. The computing device 118 can determine the confidence values 222 using the downhole data 220, operation characteristics, or a combination thereof. Examples of operation characteristics can include distance from the well trajectory 302 or material of the geological formation 104. For example, a first subset of the downhole data 220 obtained farther from the well trajectory 302 with respect to true vertical depth 230 may have lower confidence values 222 than a second subset of the downhole data 220 that is obtained closer to the well trajectory 302.

Additionally, the computing device 118 can display a depth of detection limit 304 that can define a boundary in the inversion model 214 beyond which the confidence values 222 are below a predefined threshold 228. The depth of detection limit 304 can serve as a visual representation of the predefined threshold 228 on the inversion model 214 and can be displayed as a solid line, as shown in FIG. 3. Additionally or alternatively, the depth of detection limit 304 can be displayed as a dotted line, a dashed line, a segmented line, or other suitable boundary indicator. The inversion model 214 can include a first depth of detection limit 304*a* that can be above the wellbore 102 based on the true vertical depth 230 from the well surface 116. Additionally, the inversion model 214 can include a second depth of detection limit 304*b* that can be below the wellbore 102 based on the true vertical depth 230 from the well surface 116.

Additionally or alternatively, the computing device 118 can display a visual indicator 212 that can represent the confidence values 222 for the inversion model 214. In FIG. 3, the visual indicator 212 is displayed as the visual overlay 316. The visual overlay 316 can be displayed on the entire inversion model 214, a vertical segment 310*a* of the inversion model 214, a subset of the inversion model 214 outside of a predefined threshold 228, or on any other portion of the inversion model 214. The visual overlay 316 additionally may be toggled on and off to display the inversion model 214 with the visual overlay 316 or without the visual overlay 316.

The visual overlay 316 can be displayed on a first side 312*a* of the depth of detection limit 304 that is between the depth of detection limit 304 and the wellbore 102. The visual overlay 316 displayed on the first side 312*a* can be used to highlight or emphasize the subset of the inversion model 214. For example, the visual overlay 316 displayed on the first side 312*a* can include a color with high luminance, a specific pattern, or other suitable visual emphasis to highlight one or more rock units. The wellbore operation or subsequent wellbore operations can be adjusted to avoid the one or more rock units. Additionally or alternatively, the visual overlay 316 can be displayed on a second side 312*b* of the depth of detection limit 304 that is between the depth of detection limit 304 and an edge 314 of the inversion model 214. The visual overlay 316 displayed on the second side 312*b* can be used to tone down or underemphasize the subset of the inversion model 214. For example, the visual overlay 316 displayed on the second side 312*b* can include a decrease in opacity to tone down a section of the inversion model 214 that has lower confidence than another section of the inversion model 214.

As depicted in FIG. 3, the first regions 308*a* of the inversion model 214 can include a first subset with a first transparency value 226*a* that can have lower opacity than a second subset with a second transparency value 226*b*. As mentioned above, the entire first region 308*a* can be determined to represent high resistivity data. The downhole data 220 for the second subset with the second transparency value 226*b* can be further determined to have higher confidence values 222 than the first subset with the first transparency value 226*a*. Additionally, the confidence values 222 can be determined to be lower because the first subset of the inversion model 214 is outside of the depth of detection limit 304. Therefore, the inversion model 214 with the visual overlay 316 can be useful for adjusting the wellbore operation or subsequent wellbore operations.

In some examples, the inversion model 214 can include distance indicators 306 that provide a reference to a change in distance, such as with respect to the true vertical depth 230 from the well surface 116. The distance indicators can be displayed as a solid line or as a dashed line as shown in FIG. 3. Additionally or alternatively, the distance indicators can be displayed as a dotted line, a dotted-and-dashed line, or other suitable boundary indicators. For example, a first distance indicator 306*a* and a second distance indicator 306*b* are shown in FIG. 3. The first distance indicator 306*a* can indicate a greater distance from the wellbore 102 based on the true vertical depth 230 compared to the second distance indicator 306*b*. A distance for the wellbore operation can be determined using the distance indicators 306. The wellbore operation can be adjusted accordingly. For example, the wellbore operation can be directed to proceed in an upward direction opposite to the direction of gravity while maintaining a safe distance away from the well surface 116 based on the distance indicators 306.

Figure 4:
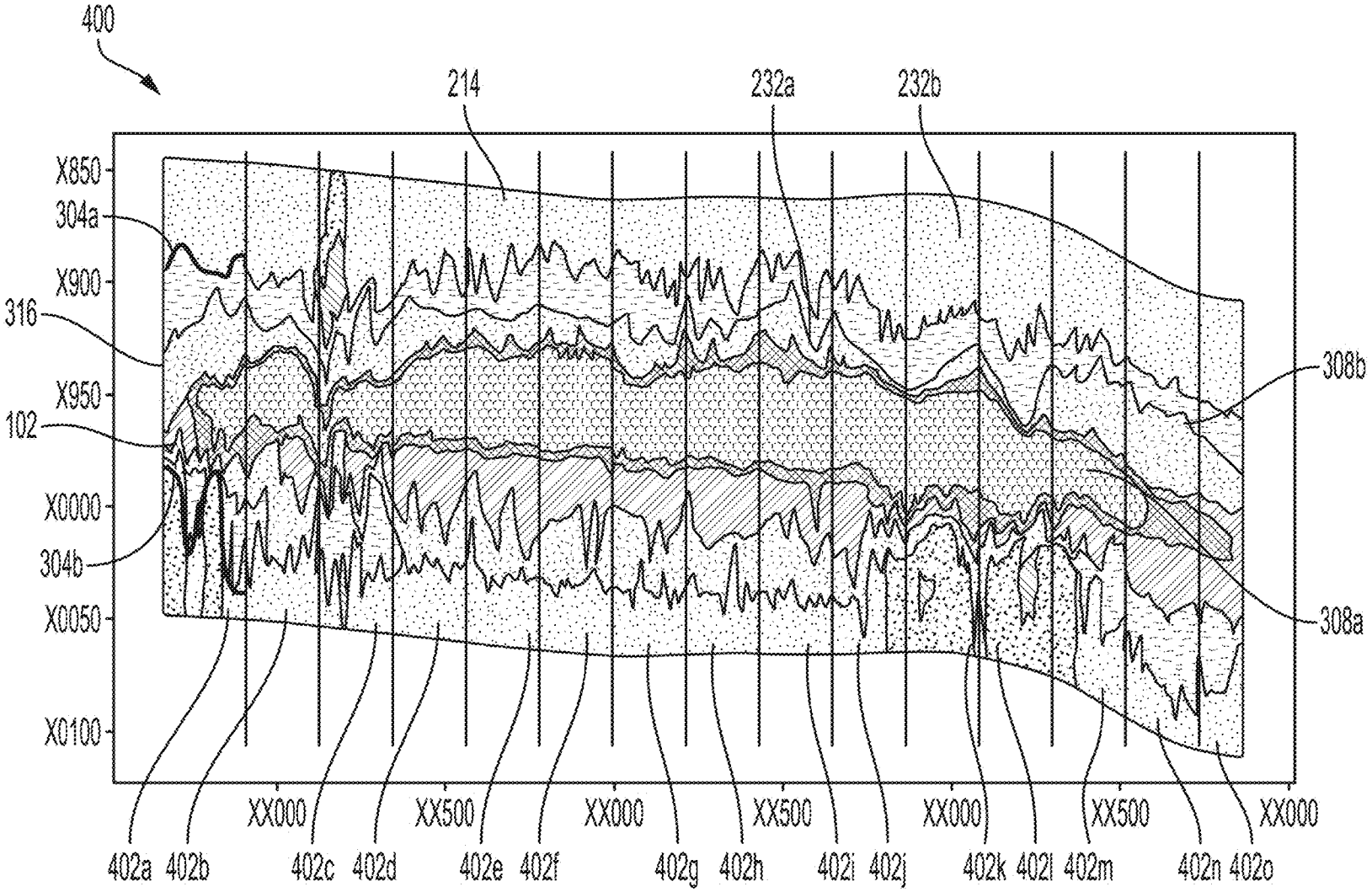
FIG. 4 is an example of a graphical user interface of an inversion model of a wellbore with a visual indicator based on saturation values according to one example of the present disclosure.

FIG. 4 is an example of a graphical user interface 400 of an inversion model 214 of a wellbore 102 with a visual indicator 212 based on saturation values 232*a-b* according to one example of the present disclosure. FIG. 4. is described with references to components shown in FIGS. 1-3. The inversion model 214 is sectioned into vertical segments 402*a-o*. In some examples, as shown in FIG. 4, the visual indicator 212 can be displayed as a visual overlay 316.

The inversion model 214 can be outputted by a computing device 118 after being generated from the downhole data 220 using inversion processing. High resistivity data, represented in FIG. 4 by a first region 308*a*, may indicate a hydrocarbon-bearing formation adjacent to or within the wellbore 102. Low resistivity data, represented in FIG. 4 by a second region 308*b*, may indicate the presence of electrical conductors, such as ionic fluids or ore deposits. The computing device 118 can determine confidence values 222 for the inversion model 214 based on the downhole data, operation characteristics, or a combination thereof. The confidence values 222 can represent a statistical confidence regarding an accuracy of a measured value. Operation characteristics used to determine the confidence values 222 can include distance from a well trajectory, spacing in a downhole tool 110, and material of a geological formation 104.

In some examples, the computing device 118 can determine a depth of detection limit 304 for the inversion model 214 by determining confidence values 222 that can exceed a predefined threshold 228. The depth of detection limit 304 can be displayed with the inversion model 214 as a visual boundary where the confidence value exceeds the predefined threshold 228, such as a ninety-five percent confidence value, and can be determined for each of the vertical segments 402*a-o*. The inversion model 214 can include a first depth of detection limit 304*a* that can be above the wellbore 102 based on a true vertical depth 230 from the well surface 116. The inversion model 214 also can include a second depth of detection limit 304*b* that can be located below the wellbore 102 based on the true vertical depth 230 from the well surface 116.

Additionally or alternatively, the visual overlay 316 for the inversion model 214 can include a first portion with a first saturation value 232*a* that has higher saturation than a second portion with a second saturation value 232*b*. The first portion having higher saturation than the second portion can indicate that the first portion corresponds to higher confidence values for the downhole data 220 compared to the second portion. A wellbore operation or subsequent wellbore operations can be adjusted based on a difference in saturation value between the first saturation value 232*a* and the second saturation value 232*b*. In some examples, the inversion model 214 with adjustments to saturation for the visual overlay 316 can be used to direct a drilling operation to the first portion of the inversion model 214 with a relatively high saturation value. The relatively high saturation value may correspond to a color with relatively high luminance. The second portion of the inversion model 214 having a lower saturation value can result in a color on the grayscale. The first portion of the inversion model 214 with the color with relatively high luminance can have a higher confidence value 222 than the second portion with the color on the grayscale. Operating in the first portion of the inversion model 214 with higher confidence values 222 can result in a more successful or a more effective wellbore operation compared to operating in the second portion with lower confidence values 222. Visual representations in the inversion model 214 that appear in the area with lower confidence values 222 may not be accurate or may not exist.

Figure 5:
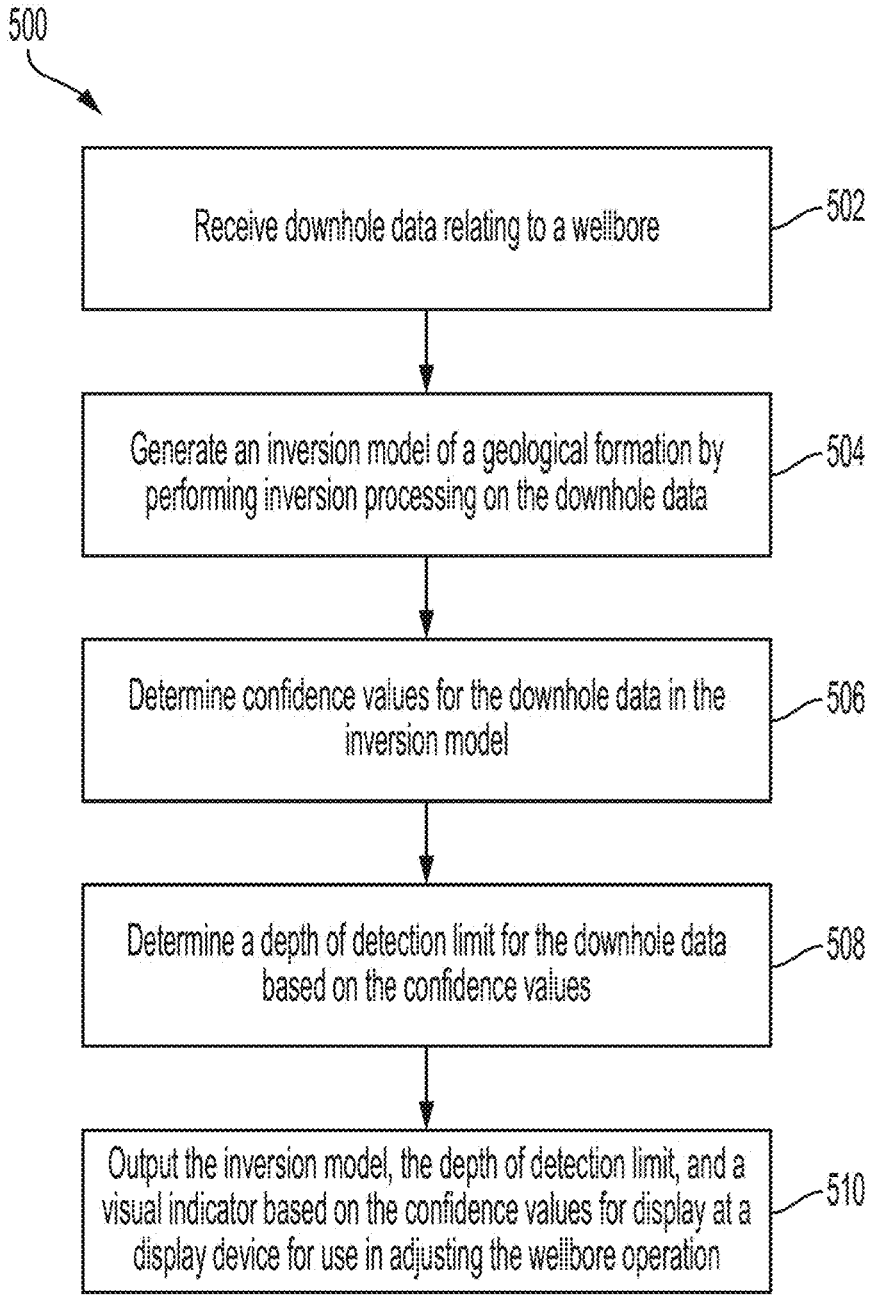
FIG. 5 is a flowchart of a process for displaying confidence values in wellbore inversion modeling using a visual indicator according to one example of the present disclosure.

FIG. 5 is a flowchart of a process 500 for displaying confidence values 222 in wellbore inversion modeling using a visual indicator 212 according to one example of the present disclosure. The process 500 is described with references to components shown in FIGS. 1-4.

At block 502, the process 500 can involve receiving, by a processing device 202, downhole data 220 relating to a wellbore 102 via a downhole tool 110. The wellbore 102 can be drilled within a geological formation 104 and have a horizontal well trajectory 302, as displayed in FIG. 3, or a vertical well trajectory. The geological formation 104 can be formed from shale, sand, clay, and other such geological material. The downhole tool 110 can measure, log, or otherwise gather the downhole data 220. In some examples, the downhole data 220 can be resistivity data. The resistivity data can be data relating to the electrical resistivity of the geological formation 104. High resistivity data can indicate a presence of electrical insulators, such as hydrocarbon fluids, while low resistivity data can indicate a presence of electrical conductors, such as ore deposits. The downhole data 220 can also relate to the density, porosity, or inclination of the geological formation 104.

At block 504, the process 500 can involve generating, by the processing device 202, an inversion model 214 of the geological formation 104 by performing inversion processing on the downhole data 220. The inversion processing can involve the processing device 202 generating a start model from the downhole data 220 and a synthetic data set based on a theoretical data collection. The theoretical data collection can occur under similar conditions to the start model. Additionally, the start model can be adjusted into the inversion model 214 by comparing the downhole data 220 with the synthetic data set. The processing device 202 additionally can repeatedly generate a new synthetic data set and can repeatedly adjust the start model by comparing the downhole data 220 with the new synthetic data set. Comparing the downhole data 220 with the new synthetic data set can improve the fit between the downhole data 220 and the synthetic data set. Once a difference between the downhole data 220 and the synthetic data set is minimized, the downhole data 220 can be used to create the inversion model 214.

At block 506, the process 500 can involve determining, by the processing device 202, the confidence values 222 for the downhole data 220 in the inversion model 214. The downhole data 220, operation characteristics of a wellbore operation, or a combination thereof can be used by the processing device 202 to determine the confidence values 222. The operation characteristics of the wellbore operation can include material of the geological formation 104, frequency used by a transmitter, or spacing used for the downhole tool 110. For example, a lower frequency used by the transmitter can result in the downhole data 220 having higher confidence values 222 compared to a higher frequency used. The confidence values 222 can represent a statistical significance regarding a probability that a parameter may fall between a set of values. For example, high confidence values 222 may include confidence values 222 greater than fifty percent, and low confidence values 222 may include confidence values 222 lower than fifty percent or equal to fifty percent. In some examples, the high confidence values 222 can indicate a high likelihood that a subset of the downhole data 220 corresponding to the high confidence values 222 is accurate.

At block 508, the process 500 can involve determining, by the processing device 202, a depth of detection limit 224 for the downhole data 220 based on the confidence values 222. The depth of detection limit 224 can be used in the wellbore operation to determine a distance from the wellbore 102 that the downhole tool 110 can acquire significant or reliable downhole data 220. The depth of detection limit 224 can be determined by the processing device 202 for the inversion model 214 at a distance from the wellbore 102 based on a true vertical depth 230 where the confidence values 222 become lower than a predefined threshold 228. As an example, the predefined threshold 228 for the confidence values 222 may be seventy-five percent. As discussed above, the spacing used for the downhole tool 110 can affect the confidence values 222, thereby also affecting the depth of detection limit 224. As an example, a larger distance between a first portion of the downhole tool 110 and a second portion of the downhole tool 110 can increase the depth of detection limit 224. Downhole data 220 gathered by the downhole tool 110 with greater spacing between the first portion and the second portion can have higher confidence values 222 than downhole data gathered by a downhole tool with less spacing. Additionally, the processing device 202 can divide the inversion model 214 into vertical segments 402*a-o*. The depth of detection limit 224 can be a boundary where a confidence value of the confidence values 222 exceeds the predefined threshold 228 for each vertical segment 402*a-o*. The processing device 202 can include a different predefined threshold 228 for each vertical segment 402*a-o* or a same predefined threshold 228 for each vertical segment 402*a-o*. The confidence values 222 can be used in generating a visual indicator 212 for the inversion model 214.

At block 510, the process 500 can involve outputting, by the processing device 202, the inversion model 214, the depth of detection limit 224, a visual indicator 212 based on the confidence values 222, or a combination thereof for display at a display device 210. The wellbore operation may be adjusted based on the inversion model 214, the visual indicator 212, or a combination thereof. Adjusting the wellbore operation can increase a success rate of the wellbore operation. The inversion model 214 can be sectioned into one or more areas by the visual indicator 212 where the inversion model 214 within each area has similar confidence values 222 while each area has different confidence values 222. For example, a first area of the inversion model 214 can have confidence values 222 of within two percentage points of a predefined threshold 228 of seventy-five percent. A second area of the inversion model 214 can have confidence values 222 more than two percentage points below the predefined threshold 228. A difference in confidence values 222 can be determined more easily and more quickly between the first area of the inversion model 214 and the second area of the inversion model 214 using the visual indicator 212.

In some examples, the processing device 202 may automatically adjust the wellbore operation. For example, the processing device 202 may determine that the well trajectory 302 is on a path likely to reach an area of the geological formation 104 in which the confidence values 222 are relatively low, so the processing device 202 can adjust the well trajectory 302 to remain in an area where the confidence values 222 are relatively high. In some examples, the inversion model 214, the visual indicator 212, or a combination thereof can be used to detect a geological feature in the geological formation 104 adjacent to the well trajectory 302 for the wellbore operation. The geological feature can include rock formations, shallow gas, hydrocarbon-bearing formations, mineral deposits, or other features in the geological formation 104. The processing device 202 may alter the well trajectory 302 in response to detecting the geological feature in the geological formation 104 by directing a drill bit to avoid the presence of the obstacles.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a perspective view of a well system with a downhole tool that can be used to collect data according to one example of the present disclosure.

FIG. 2 is a block diagram of a computing system for displaying confidence values in wellbore inversion modeling using a visual indicator according to one example of the present disclosure.

FIG. 3 is an example of a graphical user interface of an inversion model of a wellbore with a visual overlay based on transparency values according to one example of the present disclosure.

FIG. 4 is an example of a graphical user interface of an inversion model of a wellbore with a visual indicator based on saturation values according to one example of the present disclosure.

FIG. 5 is a flowchart of a process for displaying confidence values in wellbore inversion modeling using a visual indicator according to one example of the present disclosure.

In some aspects, a system, a method, and a non-transitory computer-readable medium for displaying confidence values in wellbore inversion modeling using a visual indicator are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processing device; and a memory device that includes instructions executable by the processing device for causing the processing device to perform operations comprising: receiving, from a downhole tool deployable in a wellbore of a geological formation during a wellbore operation, downhole data relating to the wellbore; generating an inversion model of the geological formation by performing inversion processing on the downhole data; determining a plurality of confidence values for the downhole data in the inversion model; determining a depth of detection limit for the downhole data based on the plurality of confidence values; and outputting the inversion model, the depth of detection limit, and a visual indicator based on the plurality of confidence values for display at a display device for use in adjusting the wellbore operation.

Example 2 is the system of example(s) 1, wherein the wellbore comprises a horizontal wellbore and determining the depth of detection limit comprises: dividing the inversion model into a plurality of vertical segments along the horizontal wellbore; determining, for each vertical segment of the plurality of vertical segments, a confidence value of the plurality of confidence values that exceeds a predefined threshold; and determining the depth of detection limit as a boundary where the confidence value exceeds the predefined threshold for each vertical segment of the plurality of vertical segments.

Example 3 is the system of example(s) 1-2, wherein outputting the visual indicator comprises: displaying the visual indicator as a visual overlay on a subset of the inversion model external to the depth of detection limit, the visual overlay having at least one transparency value associated with a confidence value of the plurality of confidence values, the visual overlay configured to reduce an opacity of the subset of the inversion model.

Example 4 is the system of example(s) 1-3, wherein the visual overlay comprises a first transparency value and a second transparency value of the at least one transparency value, the first transparency value being associated with a lower confidence value of the plurality of confidence values than the second transparency value, the first transparency value configured to reduce the opacity of the subset of the inversion model more than the second transparency value.

Example 5 is the system of example(s) 1-4, wherein outputting the visual indicator comprises: adjusting at least one saturation value of a subset of the inversion model external to the depth of detection limit, the at least one saturation value being associated with a confidence value of the plurality of confidence values.

Example 6 is the system of example(s) 1-5, wherein determining the plurality of confidence values comprises determining the plurality of confidence values based on operation characteristics, the downhole data, or a combination thereof.

Example 7 is the system of example(s) 1-6, wherein the operations further comprise: detecting, from the visual indicator and the inversion model, a geological feature in the geological formation, the geological feature in the geological formation being adjacent to a well trajectory for the wellbore operation; determining an adjustment to the wellbore operation based on the geological feature being adjacent to the well trajectory; and in response to determining the adjustment, automatically controlling the wellbore operation to perform the adjustment to alter the well trajectory.

Example 8 is the system of example(s) 1-7, wherein outputting the visual indicator comprises: adjusting at least one brightness value or at least one contrast value of a subset of the inversion model external to the depth of detection limit, the at least one brightness value or the at least one contrast value being associated with a confidence value of the plurality of confidence values.

Example 9 is a method comprising: receiving, from a downhole tool deployable in a wellbore of a geological formation during a wellbore operation, downhole data relating to the wellbore; generating an inversion model of the geological formation by performing inversion processing on the downhole data; determining a plurality of confidence values for the downhole data in the inversion model; determining a depth of detection limit for the downhole data based on the plurality of confidence values; and outputting the inversion model, the depth of detection limit, and a visual indicator based on the plurality of confidence values for display at a display device for use in adjusting the wellbore operation.

Example 10 is the method of example(s) 9, wherein the wellbore comprises a horizontal wellbore and determining the depth of detection limit comprises: dividing the inversion model into a plurality of vertical segments along the horizontal wellbore; determining, for each vertical segment of the plurality of vertical segments, a confidence value of the plurality of confidence values that exceeds a predefined threshold; and determining the depth of detection limit as a boundary where the confidence value exceeds the predefined threshold for each vertical segment of the plurality of vertical segments.

Example 11 is the method of example(s) 9-10, wherein outputting the visual indicator comprises: displaying the visual indicator as a visual overlay on a subset of the inversion model external to the depth of detection limit, the visual overlay having at least one transparency value associated with a confidence value of the plurality of confidence values, the visual overlay configured to reduce an opacity of the subset of the inversion model.

Example 12 is the method of example(s) 9-11, wherein the visual overlay comprises a first transparency value and a second transparency value of the at least one transparency value, the first transparency value being associated with a lower confidence value of the plurality of confidence values than the second transparency value, the first transparency value configured to reduce the opacity of the subset of the inversion model more than the second transparency value.

Example 13 is the method of example(s) 9-12, wherein outputting the visual indicator comprises: adjusting at least one saturation value of a subset of the inversion model external to the depth of detection limit, the at least one saturation value being associated with a confidence value of the plurality of confidence values.

Example 14 is the method of example(s) 9-13, wherein determining the plurality of confidence values comprises determining the plurality of confidence values based on operation characteristics, the downhole data, or a combination thereof.

Example 15 is the system of example(s) 9-14, wherein the operations further comprise: detecting, from the visual indicator and the inversion model, a geological feature in the geological formation, the geological feature being adjacent to a well trajectory for the wellbore operation; determining an adjustment to the wellbore operation based on the geological feature being adjacent to the well trajectory; and in response to determining the adjustment, automatically controlling the wellbore operation to perform the adjustment to alter the well trajectory.

Example 16 is the method of example(s) 9-15, wherein outputting the visual indicator comprises: adjusting at least one brightness value or at least one contrast value of a subset of the inversion model external to the depth of detection limit, the at least one brightness value or the at least one contrast value being associated with a confidence value of the plurality of confidence values.

Example 17 is a non-transitory computer-readable medium comprising instructions that are executable by a processing device for causing the processing device to perform operations comprising: receiving, from a downhole tool deployable in a wellbore of a geological formation during a wellbore operation, downhole data relating to the wellbore; generating an inversion model of the geological formation by performing inversion processing on the downhole data; determining a plurality of confidence values for the downhole data in the inversion model; determining a depth of detection limit for the downhole data based on the plurality of confidence values; and outputting the inversion model, the depth of detection limit, and a visual indicator based on the plurality of confidence values for display at a display device for use in adjusting the wellbore operation.

Example 18 is the non-transitory computer-readable medium of example(s) 17, wherein the wellbore comprises a horizontal wellbore and determining the depth of detection limit comprises: dividing the inversion model into a plurality of vertical segments along the horizontal wellbore; determining, for each vertical segment of the plurality of vertical segments, a confidence value of the plurality of confidence values that exceeds a predefined threshold; and determining the depth of detection limit as a boundary where the confidence value exceeds the predefined threshold for each vertical segment of the plurality of vertical segments.

Example 19 is the non-transitory computer-readable medium of example(s) 17-18, wherein outputting the visual indicator comprises: displaying the visual indicator as a visual overlay on a subset of the inversion model external to the depth of detection limit, the visual overlay having at least one transparency value associated with a confidence value of the plurality of confidence values, the visual overlay configured to reduce an opacity of the subset of the inversion model.

Example 20 is the non-transitory computer-readable medium of example(s) 17-19, wherein the operations further comprise: detecting, from the visual indicator and the inversion model, a geological feature in the geological formation, the geological feature being adjacent to a well trajectory for the wellbore operation; determining an adjustment to the wellbore operation based on the geological feature being adjacent to the well trajectory; and in response to determining the adjustment, automatically controlling the wellbore operation to perform the adjustment to alter the well trajectory.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processing device; and a memory device that includes instructions executable by the processing device for causing the processing device to perform operations comprising:

receiving, from a downhole tool deployable in a wellbore of a geological formation during a wellbore operation, downhole data relating to the wellbore;

generating an inversion model of the geological formation by performing inversion processing on the downhole data;

determining a plurality of confidence values for the downhole data in the inversion model;

determining a depth of detection limit for the downhole data based on the plurality of confidence values;

outputting the inversion model, the depth of detection limit, and a visual indicator based on the plurality of confidence values for display at a display device for use in adjusting the wellbore operation, wherein the visual indicator is displayable as a visual overlay on a subset of the inversion model external to the depth of detection limit to adjust a visual property; and based on detecting a geological feature adjacent to a well trajectory of the wellbore operation, outputting a command to alter the well trajectory by directing a drill bit to avoid the geological feature.

2. The system of claim 1, wherein the wellbore comprises a horizontal wellbore and determining the depth of detection limit comprises:

dividing the inversion model into a plurality of vertical segments along the horizontal wellbore;

determining, for each vertical segment of the plurality of vertical segments, a confidence value of the plurality of confidence values that exceeds a predefined threshold; and determining the depth of detection limit as a boundary where the confidence value exceeds the predefined threshold for each vertical segment of the plurality of vertical segments.

3. The system of claim 1, wherein the visual property corresponds to transparency, and wherein outputting the visual indicator comprises:

displaying the visual indicator by reducing an opacity of the subset of the inversion model, wherein the visual overlay comprises at least one transparency value associated with a confidence value of the plurality of confidence values.

4. The system of claim 3, wherein the visual overlay comprises a first transparency value and a second transparency value of the at least one transparency value, the first transparency value being associated with a lower confidence value of the plurality of confidence values than the second transparency value, the first transparency value configured to reduce the opacity of the subset of the inversion model more than the second transparency value.

5. The system of claim 1, wherein the visual property corresponds to saturation, and wherein outputting the visual indicator comprises:

adjusting at least one saturation value of the subset of the inversion model external to the depth of detection limit, the at least one saturation value being associated with a confidence value of the plurality of confidence values.

6. The system of claim 1, wherein determining the plurality of confidence values comprises determining the plurality of confidence values based on operation characteristics, the downhole data, or a combination thereof.

7. The system of claim 1, wherein the operations further comprise:

detecting, from the visual indicator and the inversion model, the geological feature adjacent to the well trajectory for the wellbore operation;

determining an adjustment to the wellbore operation based on the geological feature being adjacent to the well trajectory, wherein the adjustment comprises altering the well trajectory; and in response to determining the adjustment, automatically controlling the wellbore operation to perform the adjustment to alter the well trajectory.

8. The system of claim 1, wherein the visual property corresponds to brightness or contrast, and wherein outputting the visual indicator comprises:

adjusting at least one brightness value or at least one contrast value of the subset of the inversion model external to the depth of detection limit, the at least one brightness value or the at least one contrast value being associated with a confidence value of the plurality of confidence values.

9. A method comprising:

receiving, from a downhole tool deployable in a wellbore of a geological formation during a wellbore operation, downhole data relating to the wellbore;

generating an inversion model of the geological formation by performing inversion processing on the downhole data;

determining a plurality of confidence values for the downhole data in the inversion model;

determining a depth of detection limit for the downhole data based on the plurality of confidence values;

outputting the inversion model, the depth of detection limit, and a visual indicator based on the plurality of confidence values for display at a display device for use in adjusting the wellbore operation, wherein the visual indicator is displayable as a visual overlay on a subset of the inversion model external to the depth of detection limit to adjust a visual property; and based on detecting a geological feature adjacent to a well trajectory of the wellbore operation, outputting a command to alter the well trajectory by directing a drill bit to avoid the geological feature.

10. The method of claim 9, wherein the wellbore comprises a horizontal wellbore and determining the depth of detection limit comprises:

dividing the inversion model into a plurality of vertical segments along the horizontal wellbore;

determining, for each vertical segment of the plurality of vertical segments, a confidence value of the plurality of confidence values that exceeds a predefined threshold; and determining the depth of detection limit as a boundary where the confidence value exceeds the predefined threshold for each vertical segment of the plurality of vertical segments.

11. The method of claim 9, wherein the visual property corresponds to transparency, and wherein outputting the visual indicator comprises:

displaying the visual indicator by reducing an opacity of the subset of the inversion model, wherein the visual overlay comprises at least one transparency value associated with a confidence value of the plurality of confidence values.

12. The method of claim 11, wherein the visual overlay comprises a first transparency value and a second transparency value of the at least one transparency value, the first transparency value being associated with a lower confidence value of the plurality of confidence values than the second transparency value, the first transparency value configured to reduce the opacity of the subset of the inversion model more than the second transparency value.

13. The method of claim 9, wherein the visual property corresponds to saturation, and wherein outputting the visual indicator comprises:

adjusting at least one saturation value of the subset of the inversion model external to the depth of detection limit, the at least one saturation value being associated with a confidence value of the plurality of confidence values.

14. The method of claim 9, wherein determining the plurality of confidence values comprises determining the plurality of confidence values based on operation characteristics, the downhole data, or a combination thereof.

15. The method of claim 9, further comprising:

detecting, from the visual indicator and the inversion model, the geological feature adjacent to the well trajectory for the wellbore operation;

determining an adjustment to the wellbore operation based on the geological feature being adjacent to the well trajectory, wherein the adjustment comprises altering the well trajectory; and in response to determining the adjustment, automatically controlling the wellbore operation to perform the adjustment to alter the well trajectory.

16. The method of claim 9, wherein the visual property corresponds to brightness or contrast, and wherein outputting the visual indicator comprises:

adjusting at least one brightness value or at least one contrast value of the subset of the inversion model external to the depth of detection limit, the at least one brightness value or the at least one contrast value being associated with a confidence value of the plurality of confidence values.

17. A non-transitory computer-readable medium comprising instructions that are executable by a processing device for causing the processing device to perform operations comprising:

receiving, from a downhole tool deployable in a wellbore of a geological formation during a wellbore operation, downhole data relating to the wellbore;

generating an inversion model of the geological formation by performing inversion processing on the downhole data;

determining a plurality of confidence values for the downhole data in the inversion model;

determining a depth of detection limit for the downhole data based on the plurality of confidence values;

outputting the inversion model, the depth of detection limit, and a visual indicator based on the plurality of confidence values for display at a display device for use in adjusting the wellbore operation, wherein the visual indicator is displayable as a visual overlay on a subset of the inversion model external to the depth of detection limit to adjust a visual property; and based on detecting a geological feature adjacent to a well trajectory of the wellbore operation, outputting a command to alter the well trajectory by directing a drill bit to avoid the geological feature.

18. The non-transitory computer-readable medium of claim 17, wherein the wellbore comprises a horizontal wellbore and determining the depth of detection limit comprises:

dividing the inversion model into a plurality of vertical segments along the horizontal wellbore;

determining, for each vertical segment of the plurality of vertical segments, a confidence value of the plurality of confidence values that exceeds a predefined threshold; and determining the depth of detection limit as a boundary where the confidence value exceeds the predefined threshold for each vertical segment of the plurality of vertical segments.

19. The non-transitory computer-readable medium of claim 17, wherein the visual property corresponds to transparency, and wherein outputting the visual indicator comprises:

displaying the visual indicator by reducing an opacity of the subset of the inversion model, wherein the visual overlay comprises at least one transparency value associated with a confidence value of the plurality of confidence values.

20. The non-transitory computer-readable medium of claim 17, wherein the operations further comprise:

detecting, from the visual indicator and the inversion model, the geological feature adjacent to the well trajectory for the wellbore operation;

determining an adjustment to the wellbore operation based on the geological feature being adjacent to the well trajectory, wherein the adjustment comprises altering the well trajectory; and in response to determining the adjustment, automatically controlling the wellbore operation to perform the adjustment to alter the well trajectory.

* * * * *